US009409045B2

(12) United States Patent
Berezovsky

(10) Patent No.: US 9,409,045 B2
(45) Date of Patent: Aug. 9, 2016

(54) SOLID PROPELLANT FIRE EXTINGUISHING SYSTEM

(75) Inventor: Julia Berezovsky, Mortdale (AU)

(73) Assignee: PYROGEN MANUFACTURING SDN BHD, Shahalam (MY)

( * ) Notice: Subject to any disclaimer, the term of this patent is extended or adjusted under 35 U.S.C. 154(b) by 29 days.

(21) Appl. No.: 14/240,936

(22) PCT Filed: Apr. 20, 2012

(86) PCT No.: PCT/MY2012/000087

§ 371 (c)(1),
(2), (4) Date: Jun. 17, 2014

(87) PCT Pub. No.: WO2013/028053

PCT Pub. Date: Feb. 28, 2013

(65) Prior Publication Data

US 2014/0305668 A1 Oct. 16, 2014

(30) Foreign Application Priority Data

Aug. 25, 2011 (MY) ..... PI2011003993

(51) Int. Cl.

| | |
|---|---|
| ***A62C 13/00*** | (2006.01) |
| ***A62C 13/22*** | (2006.01) |
| ***A62C 35/02*** | (2006.01) |
| ***A62C 3/07*** | (2006.01) |

(52) U.S. Cl.
CPC . *A62C 13/22* (2013.01); *A62C 3/07* (2013.01); *A62C 13/006* (2013.01); *A62C 35/023* (2013.01)

(58) Field of Classification Search
CPC ..... A62C 3/025; A62C 5/006; A62C 13/006; A62C 13/22; A62C 19/00; A62C 35/023; A62C 35/08
See application file for complete search history.

(56) References Cited

U.S. PATENT DOCUMENTS

| | | | | |
|---|---|---|---|---|
| 5,393,437 | A | 2/1995 | Bower | |
| 5,613,562 | A | 3/1997 | Galbraith et al. | |
| 6,024,889 | A * | 2/2000 | Holland et al. | 252/5 |
| 6,513,602 | B1 * | 2/2003 | Lewis et al. | 169/84 |
| 6,612,243 | B1 * | 9/2003 | Italiane et al. | 102/367 |
| 2004/0216903 | A1 * | 11/2004 | Wierenga et al. | 169/85 |
| 2004/0226726 | A1 * | 11/2004 | Holland et al. | 169/62 |
| 2004/0262017 | A1 | 12/2004 | Gaidano et al. | |
| 2007/0007019 | A1 * | 1/2007 | Wierenga et al. | 169/30 |
| 2007/0158085 | A1 * | 7/2007 | Bourdet et al. | 169/46 |

FOREIGN PATENT DOCUMENTS

| | | |
|---|---|---|
| GB | 2306320 | 5/1997 |
| GB | 2362099 | 11/2001 |
| WO | 9523630 | 9/1995 |
| WO | 2006138733 | 12/2006 |

* cited by examiner

*Primary Examiner* — Ryan Reis
(74) *Attorney, Agent, or Firm* — Preston Smirman; Smirman IP Law, PLLC

(57) ABSTRACT

A fire extinguishing system comprises a hermetically sealed storage canister (110) fabricated with at least one gas outlet (111) and defining a hollow (112) within; a powder form fire extinguishing agent (120) stored inside the canister (110): a solid propellant (130), which is ignitable to generate gases (135); connected to the canister (110); and a rupturable seal (140) disposed at the gas outlet (111), wherein the solid propellant (130) generates gasses to aerate the fire extinguishing agent (120) inside the canister (110) and build a positive gas pressure until the gas pressure is sufficient to rupture the seal (140) for discharging the fire extinguishing agent (120) under pressurized gas flow (150).

8 Claims, 4 Drawing Sheets

SOLID PROPELLANT FIRE EXTINGUISHING SYSTEM

CROSS-REFERENCE TO RELATED APPLICATION

The instant application is a national phase of PCT International Patent Application Serial No. PCT/MY2012/000087, filed Apr. 20, 2012, and claims priority to Malaysian Patent Application Serial No. PI2011003993, filed Aug. 25, 2011, pending, the entire specifications of both of which are expressly incorporated herein by reference.

FIELD OF INVENTION

The present invention relates to a fire extinguishing system which is particularly useful in quenching fire occurring in the engine cabin of a vehicle, preferably bus. More specifically, the disclosed invention discharges powdery fire extinguishing agent under high pressure air flow to extinguish fire in confined compartments such as engine cabins.

BACKGROUND OF THE INVENTION

Fire tends to occur around the engine cabin in an automobile especially owing to overheating or oil spillage in accidents. It is crucial to cease the fire at the beginning before it spreads to other parts of the automobile particularly the fuel tank which may lead to explosions. However, the engine of an automobile is generally enclosed in a small compartment that instant access to it for quenching the fire is almost impossible. Consequently, a pre-installed fire extinguishing system within the engine cabin to quench the fire by automatic or manual operation is highly desired. For example, United Kingdom patent application no. 2306320, 2362099, and International patent application WO9523630 respectively describe fire suppressing system for automobile that pressurized gas tank is particularly utilized in the described system for quenching the fire. Despite these systems may be able to fulfill the needed fire extinguishing function, pressurized gas tanks require relatively larger space in the engine cabin for installation and it is not favorable considering the limited space available in the cramped engine cabin.

Other patented technologies can be found in United States patent publication No. US2004262017 and International patent application no. 2006138733 that inert gas-generating solid propellants are employed for removing the fire. Gas-based systems disperse inert aerosol to flaming objects to temporarily create an oxygen deprived environment to extinguish the fire and such systems are proved useful for fire incidents occurred in buildings but possibly not suitable for engine cabins. Presence of spilt gasoline in the engine cabin tends to re-combust once the aerosol is depleted therefore recurrence of the fire is likely to happen using gas-based systems. It is much preferred that the fire extinguishing properties can last until the used agent is safely removed after. Likewise, efficiency of water-based systems filled with surfactant is less effective since gasoline floats on top of water, while foaming agent or surfactant can be corrosive to the engine of the automobile. To tackle the above mentioned shortcoming, a fire extinguishing system using non-corrosive yet lasting active agent is highly desired.

SUMMARY OF THE INVENTION

The present invention aims to offer a fire extinguishing system which is capable of discharging high volume of fire extinguishing agent (120) towards a fire under high pressure to effectively suppress the fire.

Another object of the present invention is to provide a fire extinguishing system imparted with a mechanism to establish sufficient gas pressure to discharge high volume of powdery fire extinguishing agent (120) towards the fire in a relatively short duration.

Further object of the present invention is to provide a miniaturized fire extinguishing system which is suitable to be installed in a small confined compartment like engine cabin. Miniaturization of the fire extinguishing system can be attained by using solid propellant (130) to passively create pressurized gases (135) instead of pre-pressurized gases (135) as found in conventional fire extinguisher.

Still, another object of the present invention is to disclose afire extinguishing system capable of avoiding caking of the powdery fire extinguishing agent (120) owing to prolonged storage.

At least one of the preceding objects is met, in whole or in part, by the present invention, in which one of the embodiments of the present invention is a fire extinguishing system comprising a hermetically sealed storage canister (110) fabricated with at least one gas outlet (111) and defining a hollow (112) within; a powder form fire extinguishing agent (120) stored inside the canister (110); a solid propellant (130), which is electrically ignitable to generate gases (135); connected to the canister (110); and a rupturable seal (140) disposed at the gas outlet (111), wherein the solid propellant (130) generates gasses to aerate the fire extinguishing agent (120) inside the canister (110) and build a positive gas pressure until the gas pressure is sufficient to rupture the seal (140) for discharging the fire extinguishing agent (120) under pressurized gas flow (150).

To effectively deliver the fire extinguishing agent (120) within the engine cabin for quenching the fire, the disclosed system may further comprise a distribution piping (160) attached to the gas outlet (111) to channel the discharged fire extinguishing agent (120).

In another aspect, the disclosed system can be activated either automatically or manually by the user. To allow manual activation, the disclosed system may further be incorporated with a switch communicating with the solid propellant (130) and capable of electrically igniting the solid propellant (130) upon pressing the switch, while at least one linear heat detector (180) electrically connects the solid propellant (130) to an electrical power source and capable of igniting the solid propellant (130) upon subjected to heat exceeding a preset temperature in the automatic mode.

In another aspect, a pressure valve is fabricated on the canister (110) to prevent possible explosion by venting out the generated gasses once the pressure within the canister (110) exceeds a predetermined value.

To avoid caking of the powdery fire extinguishing agent (120), the gasses generated from the solid propellant (130) is directed into the canister (110) through a tubular structure which has an outlet point submerged into the powder form fire extinguishing agent (120). The powder form fire extinguishing agent (120) used in the present invention is a mixture of mono ammonium phosphate and ammonium sulfate in a ratio of 20% to 45%:55% to 85%.

DETAILED DESCRIPTION OF THE INVENTION

One skilled in the art will readily appreciate that the present invention is well adapted to carry out the objects and obtain the ends and advantages mentioned, as well as those inherent therein. The embodiment describes herein is not intended as limitations on the scope of the invention.

Figure 1:
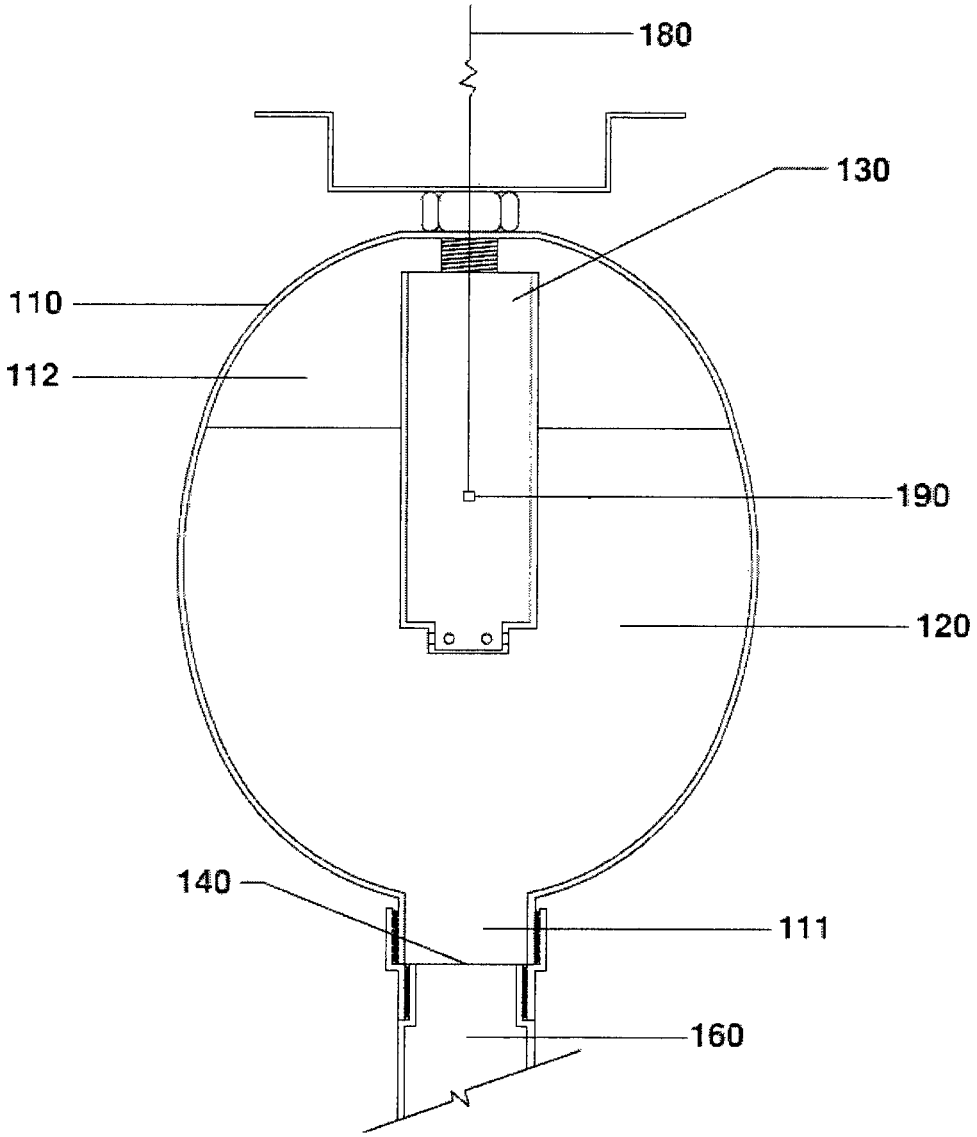
FIG. 1 shows a cross-sectional view of one embodiment of the fire canister.
Figure 2:
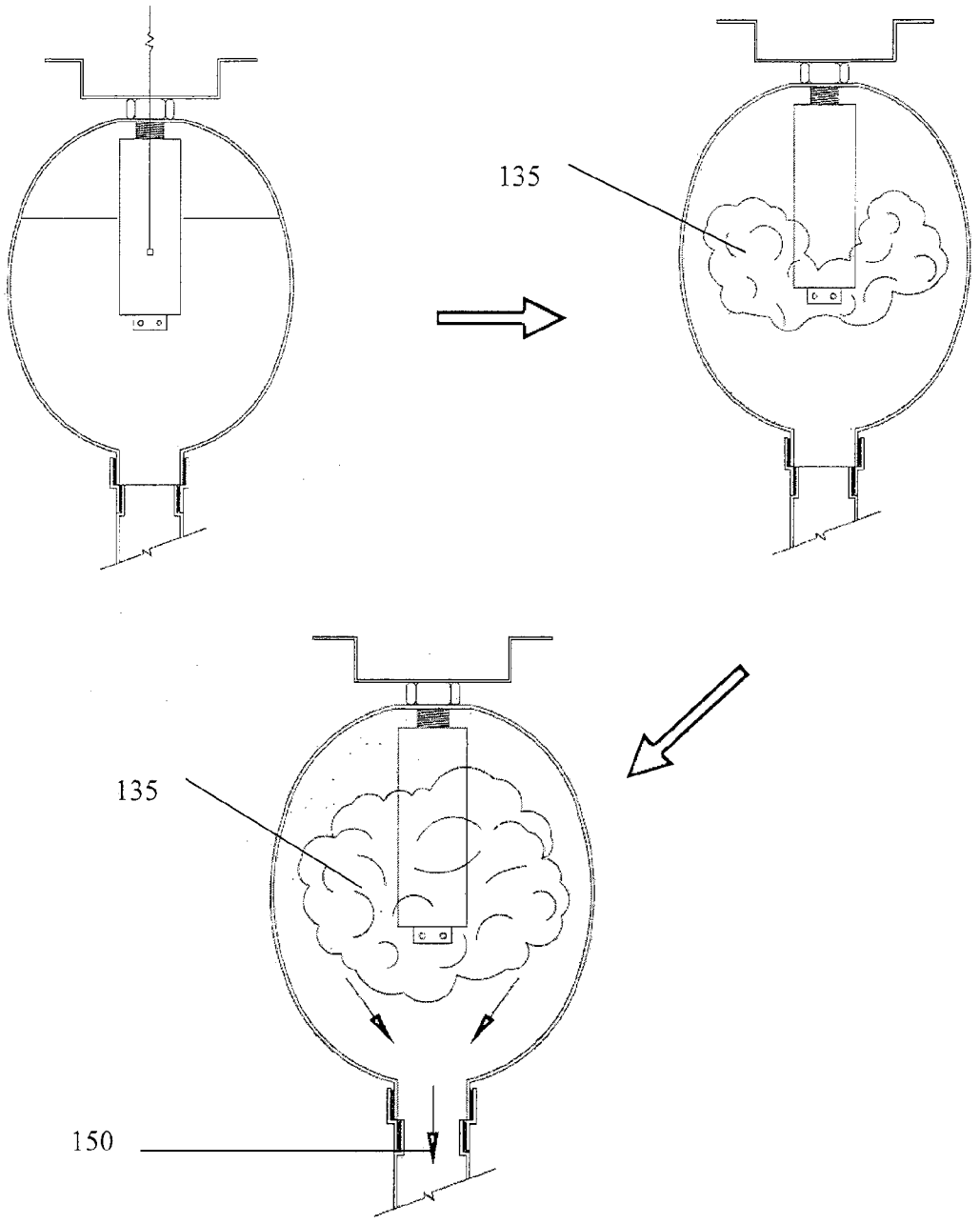
FIG. 2 shows series of actions occurring within the canister when the disclosed system is activated.
Figure 3:
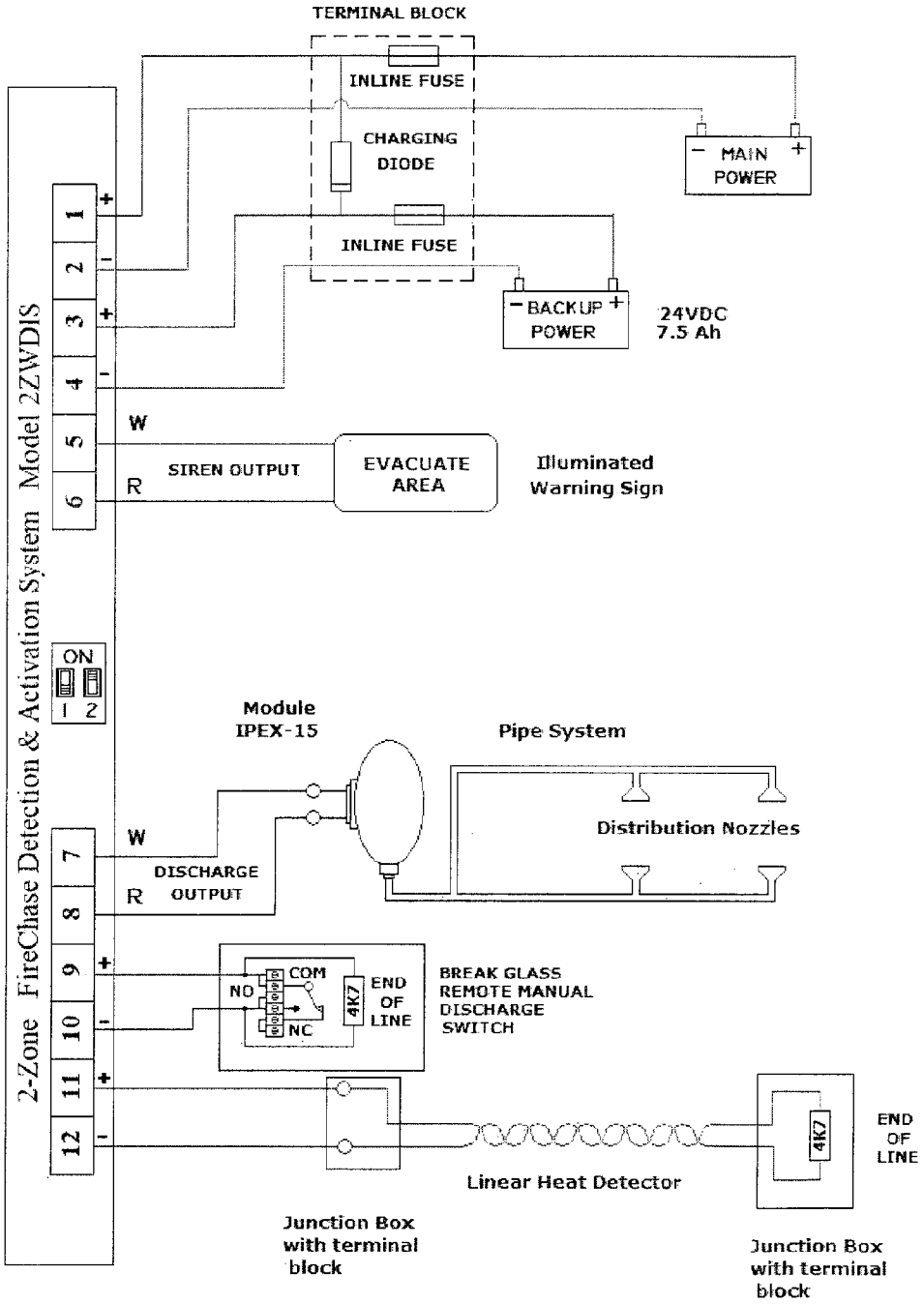
FIG. 3 is a block diagram showing layout of the disclosed system.
Figure 4:
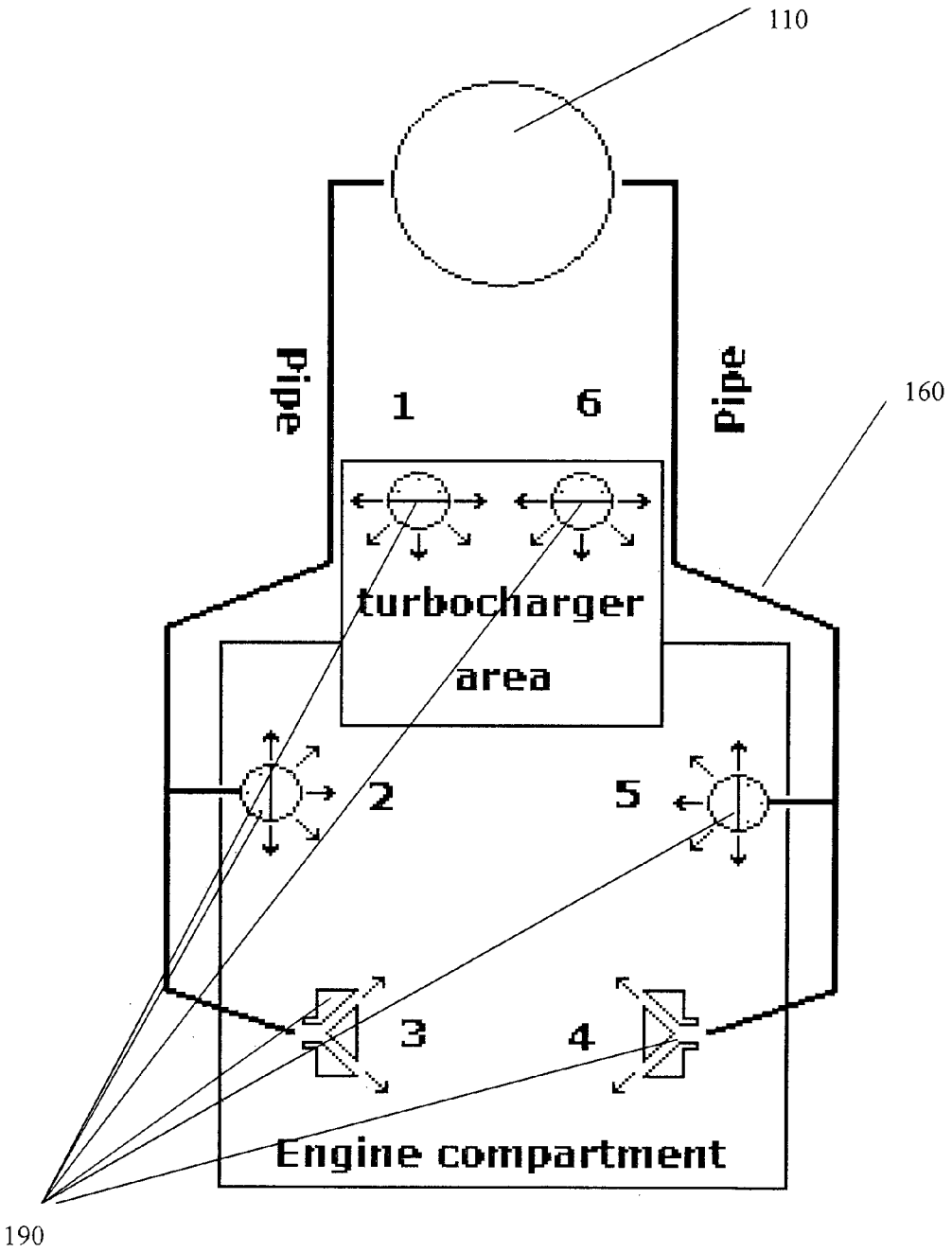
FIG. 4 shows positions of the nozzles in one embodiment of the disclosed invention.

According to the preferred embodiment, the present invention discloses, as shown in FIG. 1, a fire extinguishing system comprising a hermetically sealed storage canister (110) fabricated with at least one gas outlet (111) and defining a hollow (112) within; a powder form fire extinguishing agent (120) stored inside the canister (110); a solid propellant (130), which is ignitable to generate gases (135); connected to the canister (110); and a rupturable seal (140) disposed at the gas outlet (111), wherein the solid propellant (130) generates gasses to aerate the fire extinguishing agent (120) inside the canister (110) and build a positive gas pressure until the gas pressure is sufficient to rupture the seal (140) for discharging the fire extinguishing agent (120) under pressurized gas flow (150). Preferably, the canister (110) is a metal or alloy case which is substantially strong to sustain the abrupt pressure elevation during fire occurrence without cracking or exploding. In contrast to most of the conventional products, the disclosed system is a non-pressurized module. More specifically, the content within the canister (110) is not pressurized until the solid propellant (130) is ignited in-situ. One skilled in the art shall appreciate the fact that there are various approaches which can be employed to ignite the solid propellant (130) though the disclosed invention preferably has the solid propellant electrically ignited. Preferably, the canister (110) adopts a substantially oval or round shape with a relatively flattened back surface. The flattened back surface facilitates fixing of the canister (110) onto the any suitable walls on the engine cabin, preferably engine cabin of a bus. The substantially round and oval side and front surface of the canister (110) promote aeration of powdery fire extinguishing agent (120) to ensure the fire extinguishing agent (120) is evenly distributed to attain the optimal fire quenching effect. The gas outlet (111) fabricated on the canister (110) preferably faces downward to avoid discharging the fire extinguishing agent (120) against the gravitational force. Nonetheless, the gas outlet (111) may be fabricated on other positions to discharge the fire extinguishing agent (120) less negatively affected by the gravitational force.

As in the setting forth, the solid propellant (130) is a tool or a gas generator that the solid propellant (130) expands into high volume of inert gases (135) to propel the fire extinguishing agent (120). Though it is possible to position the solid propellant (130) outside the canister (110) and later direct the generated inert gasses into the canister (110) for aerating the fire extinguishing agent (120), the solid propellant (130) is preferably positioned within the canister (110) to minimize the space to be occupied when installing the disclosed system. Preferably, the solid propellant (130) is, but not limited to, potassium nitrate based. More preferably, the solid propellant (130) is stored inside a tubular member. The tubular member has a first end fixed within the canister (110) around the top portion and a second end, a gas outlet (111) point, buried inside the powdery fire extinguishing agent (120). This tubular structure is preferably made of strong metal or alloy serving as a means to house the solid propellant (130) and channel the generated inert gasses towards a preferred direction. Through controlling the initial movement of the generated gasses, the disclosed invention ensures the powdery fire extinguishing agent (120) is aerated in a preferred pattern to achieve optimal fire quenching efficiency once discharged. More specifically, the disclosed system has the outlet point of the tubular structure submerged into the powder form fire extinguishing agent (120) thus compelling the inert gasses to penetrate through the fire extinguishing agent (120) to effectively aerate the powder. The powdery fire extinguishing agent (120) is then adapted to whirl and spin in high velocity within the canister (110) owing to the abrupt movement of the generated inert gasses avoiding possible caking of the powder caused by prolonged storage. Preferably, the disclosed system is able to discharge the powdery fire extinguishing agent (120) to the flaming site at a rate of 1000 to 2000 g/s, more preferably 1400 to 1800 g/s. At the opposite first end, a wire extends into the tubular structure externally through the casing connecting the solid propellant (130) stored within. The disclosed system conducts a suitable electrical current through the wire to ignite the solid propellant (130).

In order to instantly quench the fire and minimize powder loss, the powdery fire extinguishing agent (120) has to be discharged at high velocity. Apart form the above mentioned unique way to aerate the powder, a high pressurized gas has to be established in short duration within the canister (110) to achieve the desired discharging velocity. As in the foregoing, the disclosed system positions a seal (140) at the gas outlet (111) of the canister (110) that this seal (140) is set to readily rupture once the internal pressure of the canister (110) reaches a preferred level. The seal (140) is preferably a membrane or metal foil, more preferably a processed aluminum or copper foil. In one embodiment, the disclosed system may use seal (140) made of laminated material to permit greater pressure to be built inside the canister (110). For example, a laminate of aluminum foils and/or plastic may be fabricated to produce a stronger seal (140). Further, scored lines maybe marked onto the seal (140) to fashion the seal (140) to rupture in a preferred way, particularly without prohibiting discharge of the fire extinguishing agent (120). Specifically, the scored lines are configured in a preferred pattern serves as the weaker spot first to tear and rupture the seal (140) for discharging the fire extinguishing agent (120). For example, the scored lines may take the form of a "X" mark on the middle of the seal (140) that the seal (140) should then be torn at the central into four different small fragments hanging on the edge of the gas outlet (111). The inert gasses together with the fire extinguishing agent (120) flow out thereof without suffering any hindrance from the torn seal (140) material itself. Preferably, the seal (140) ruptures when the internal pressure of the canister (110) reaches 1.2 to 2 MPa, more preferably at 1.6 MPa.

Pursuant to another embodiment, the powdery fire extinguishing agent (120) in the present invention plays a critical role for quenching fire in a gasoline surrounded environment. The fire extinguishing agent (120) is preferably mixtures of ABC powder and the like. Accordingly, the powder form fire extinguishing agent (120) is a mixture of mono ammonium phosphate and ammonium sulphate in a ratio of 20% to 45%: 55% to 85%. These powders are water soluble and mildly alkaline. It is important to be noted that the fire extinguishing agent (120) of the present invention can be cleaned via vacuum cleaning or water washing and shows almost no corrosion to the vehicle parts. It is well known that corrosion activity of alkaline solutions towards metal alloys is much less than of acidic solution. More preferably, the powder is subjected to hydrophobization prior to filling the canister (110) to minimize possible negative impacts towards the metal and electrical components. The mixture is specially prepared by the inventors of the present invention to handle fire incidents happened within and around engine cabin of an automobile especially fire caused by gasoline spillage. In contrary to the gas-based fire extinguishing system, the powdery fire extinguishing agent (120) remains on the targeted site to prevent possible recurrence of the fire until the condition is safe to remove the fire extinguishing agent (120) later. Particularly, the ABC powder extinguishes the fire through two major mechanisms. Firstly, the fire extinguishing agent (120) of the present invention attaches to fire propagating compounds such as oxygen, hydrogen and hydroxyl radicals found on the gasoline in the flame zone thus removing these compounds from the flame zone to discontinue the fire. Secondly, it acts as a fire blanket to shield the surface of the flaming object including gasoline and other fuel types therefore it potentially prevents recurrence of the fire. Further, the powdery fire extinguishing agent (120) also carries out series of endothermic reaction like decomposition and/or evaporation upon heated to absorb the surrounding heat to terminate the combustion. Besides the powdery fire extinguishing agent (120), the solid propellant (130) used in the present invention may also generate inert gasses with fire extinguishing property to aid fire fighting.

For quenching fire effectively in an engine cabin, the fire extinguishing system comprises a network of distribution piping (160) attached to the gas outlet (111) to channel the discharged fire extinguishing agent (120) to various areas in the engine cabin. Preferably, the distribution piping (160) is made of copper and having a total length not more than 10 meter. Any length longer than 10 meter may decrease the gas pressure and the discharging velocity of the fire extinguishing agent (120) to the flaming site. Further, the piping of the present invention may have an internal diameter of 12 mm to 25 mm and more preferably is 18 mm, while the discharge opening at the nozzle (190) is 5 mm to 18 mm in diameter. As illustrated in FIG. 5, the distribution piping (160) preferably includes two different branches to literally surround the engine and engine cabin. More preferably, each branch has at least two different nozzles (190) or three pairs of nozzles (190) for two branches. The disclosed system preferably locates at least one nozzle (190) to cover the bottom part of the engine cabin normally accumulated with oil or diesel. Fire at the bottom part has to be extinguished quickly as fire at this area can be hard to control once spread. Another nozzle (190) preferably aims at the ground area underneath the engine cabin to avoid possible fire caused by dripping of gasoline or diesel from the engine cabin. Another pair of nozzles (190) may be dedicated to protect top of the engine and engine cabin. More preferably, a pair of additional nozzle (190)s may be used to extinguish fire in turbocharger found in bus engine cabin.

To activate the disclosed system especially igniting the solid propellant (130) to discharge the powdery fire extinguishing agent (120), an automatic fire detection system is incorporated into one embodiment of the present invention. The automatic fire detection system can be any known device in the art such as heat sensor, smoke sensor or infrared sensor, though linear heat detector (180) is employed in the more preferred embodiment. More specifically, the linear heat detector (180) is a precision made twisted two-core cable with an end of line resistor and each core cable has one wire wrapped with a heat sensitive jacket. When subjected to sufficient heat, the jackets melt and the wires come into contact to allow greater current to be conducted into the solid propellant (130) for ignition. The temperature melting the jacket, or the alarm temperature, can be varied relying on the fabricating material of the jacket. The alarm temperature of the present invention can range from 68° C. to 180° C., more preferably 150° C. to 180° C. In short, the linear heat detector (180) electrically connecting the solid propellant (130) to an electrical power source and capable of igniting the solid propellant (130) upon subjected to heat exceeding a preset temperature. Additionally, the disclosed system features another standalone mechanism facilitating manual activation besides the automatic activation. An activation switch electrically communicates with the solid propellant (130), preferably via an electronic igniter, and capable of electrically igniting the solid propellant (130) upon manually turning the switch. The activation switch is preferably located around the driver seat and protected in a glass shield to prevent turning on the switch unintentionally. In the preferable embodiment, a circuit board is utilized to serve as a platform to connect and join various component of the disclosed system to operate in a predetermined logic.

In another embodiment, the disclosed system is powered by two power source, a primary power and a backup power. The primary power can be battery from the vehicle, while the backup power is a backup battery to support the disclosed system in case power outage from the primary power. Preferably, both power can supply at least 24 volt of direct current. Still, in another embodiment, a siren is mounted within the vehicle and blares out warning to notify evacuation of the passenger upon activation of the disclosed system.

The present invention also includes a safety feature in one embodiment to avoid possible explosion of the canister (110) due to the abrupt internal pressure increase. Following this embodiment, a pressure valve fabricated on the canister (110) to vent out the generated gasses once the pressure within the canister (110) exceeds a predetermined value. This predetermined value is significantly higher than the pressure to rupture seal (140) while relatively lower than the pressure capable of blowing the canister (110).

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

The invention claimed is:

1. A fire extinguishing system, comprising:

a hermetically sealed storage canister fabricated with at least one gas outlet and defining a hollow within, wherein the canister has an oval shape, wherein the canister has an area defining a flat surface formed on an external surface thereof;

a powder form fire extinguishing agent stored inside the canister, wherein the fire extinguishing agent is subjected to hydrophobization prior to filling the canister;

a potassium nitrate based solid propellant that is ignitable to generate gases and is stored inside a tubular member, wherein the tubular member has a first end fixed around a top portion of the canister and a second end defining a gas outlet point that is buried into the fire extinguishing agent, wherein the solid propellant is positioned within the canister; and a rupturable seal disposed at the gas outlet, wherein the solid propellant generates gases to sufficiently aerate the fire extinguishing agent inside the canister and build a positive gas pressure until the gas pressure is sufficient to rupture the seal for discharging the fire extinguishing agent under a pressurized gas flow;

wherein the oval shape of the canister promotes aeration of the fire extinguishing agent such that the fire extinguishing agent is evenly distributed within the canister.

2. The fire extinguishing system of claim 1, further comprising a distribution piping attached to the gas outlet to channel the discharged fire extinguishing agent.

3. The fire extinguishing system of claim 1, further comprising a switch communicating with the solid propellant and being capable of electrically igniting the solid propellant upon manually activating the switch.

4. The fire extinguishing system of claim 1, further comprising a pressure valve fabricated on the canister to vent out the generated gasses once the pressure within the canister exceeds a predetermined value.

5. The fire extinguishing system of claim 1, further comprising a linear heat detector electrically connecting the solid propellant to an electrical power source and being capable of igniting the solid propellant upon being subjected to heat exceeding a preset temperature.

6. The fire extinguishing system of claim 1, wherein the seal is fashioned to rupture without prohibiting discharge of the fire extinguishing agent.

7. The fire extinguishing system of claim 1, wherein the powder form fire extinguishing agent is a mixture of mono ammonium phosphate and ammonium sulfate in a ratio of 20% to 45%:55% to 85%.

8. The fire extinguishing system of claim 1, wherein the system is selectively operable to extinguish a fire in an engine cabin of a vehicle.

* * * * *